US011054206B2

(12) United States Patent
Tjus et al.

(10) Patent No.: US 11,054,206 B2
(45) Date of Patent: Jul. 6, 2021

(54) ARRANGEMENT AND METHOD FOR ALIGNING A SUB-CALIBRE BARREL

(71) Applicant: SAAB AB, Linkoeping (SE)

(72) Inventors: Emil Tjus, Kristinehamn (SE); Per Jansson, Degerfors (SE)

(73) Assignee: SAAB AB, Linkoeping (SE)

( * ) Notice: Subject to any disclaimer, the term of this patent is extended or adjusted under 35 U.S.C. 154(b) by 0 days.

(21) Appl. No.: 16/609,780

(22) PCT Filed: Apr. 27, 2018

(86) PCT No.: PCT/SE2018/050437
§ 371 (c)(1),
(2) Date: Oct. 31, 2019

(87) PCT Pub. No.: WO2018/203803
PCT Pub. Date: Nov. 8, 2018

(65) Prior Publication Data

US 2020/0064098 A1 Feb. 27, 2020

(30) Foreign Application Priority Data

May 2, 2017 (SE) ..... 1700080-3

(51) Int. Cl.
*F41A 21/10* (2006.01)
*F41A 33/00* (2006.01)

(52) U.S. Cl.
CPC ..... *F41A 21/10* (2013.01); *F41A 33/00* (2013.01)

(58) Field of Classification Search
CPC ..... F41A 21/10; F41A 21/48; F41A 21/482; F41A 21/485; F41A 21/487
(Continued)

(56) References Cited

U.S. PATENT DOCUMENTS 213,616 A * 3/1879 Bowles ..... F41A 21/10 42/77
351,333 A * 10/1886 Morris ..... F41A 21/10 89/29

(Continued)

FOREIGN PATENT DOCUMENTS

DE 3108988 A1 9/1982
DK 9600046 U4 2/1997

OTHER PUBLICATIONS

International Searching Authority, International Search Report and Written Opinion for International Application No. PCT/SE2018/050437, dated Jul. 13, 2018, (10 pages), Sweden.

(Continued)

*Primary Examiner* — Derrick R Morgan
(74) *Attorney, Agent, or Firm* — Alston & Bird LLP

(57) ABSTRACT

The present invention relates to an arrangement for aligning a sub-calibre barrel (1) for use in a principal weapon barrel comprising i) an insert (4) arranged in said principal weapon barrel ii) front securing means (8) for aligning the sub-calibre barrel (1) iii) rear securing means for securing the rear end of the sub-calibre barrel (1), wherein iii.a) said rear securing means comprise a barrel nut (2) in which said sub-calibre barrel (1) is inserted; iii.b) clamping means (3*a*, 3*b*) securing said barrel nut (2) to said insert (4) and said clamping means (3*a*, 3*b*) in said principal weapon barrel. The invention also relates to a training weapon comprising the arrangement and a method of aligning the training weapon.

13 Claims, 10 Drawing Sheets

A-A

(58) Field of Classification Search
USPC ..... 89/14.7, 14.5, 29; 42/75.02, 77, 76.01
See application file for complete search history.

(56) References Cited

U.S. PATENT DOCUMENTS 351,334 A * 10/1886 Morris ..... F41A 21/10 89/29
541,507 A * 6/1895 Sellers ..... F41A 21/02 89/16
679,115 A * 7/1901 Driggs ..... F41A 21/10 89/29
745,464 A * 12/1903 Tasker ..... F41A 21/10 89/29
754,412 A * 3/1904 Bevans ..... F41A 21/10 89/29
757,790 A * 4/1904 Tasker ..... F41A 21/10 89/29
1,412,151 A * 4/1922 Vollmer ..... F41A 21/482 89/16
1,468,891 A * 9/1923 Tucker ..... F41A 21/10 42/77
1,759,772 A * 5/1930 Williams ..... F41A 21/10 42/77
2,342,684 A 2/1944 Nelson
2,345,596 A * 4/1944 Green ..... F41A 13/12 89/14.5
2,454,276 A * 11/1948 Davis, Jr. ..... F41A 21/10 89/29
2,482,808 A * 9/1949 Summerbell ..... F41A 21/10 89/29
2,857,812 A * 10/1958 Nichols ..... F42B 8/10 89/29
2,872,850 A 2/1959 Davenport
2,894,347 A * 7/1959 Woodcock ..... F41A 21/482 42/75.02
2,941,326 A * 6/1960 Hamil ..... F41A 21/485 42/75.01
3,363,509 A * 1/1968 Tschoepe ..... F41A 21/26 89/14.5
4,088,056 A * 5/1978 Dallaire ..... F42B 8/10 102/444
4,605,372 A 8/1986 Nyzell
4,638,714 A * 1/1987 Heintz ..... F16C 25/04 89/14.05
4,642,928 A * 2/1987 Bertiller ..... F41A 21/10 42/77
4,648,192 A * 3/1987 Harness ..... F41A 21/10 42/75.04
4,872,390 A * 10/1989 Bertiller ..... F41A 21/10 89/29
5,415,074 A * 5/1995 Fields ..... F41A 21/10 42/77
5,729,927 A * 3/1998 Shaver, Jr. ..... F42B 8/10 42/77
5,798,473 A * 8/1998 Roblyer ..... F41A 21/28 42/75.01
6,145,440 A * 11/2000 Franzen ..... F42B 8/10 102/446
6,178,648 B1 * 1/2001 Ledys ..... F41G 3/323 42/118
6,318,230 B1 * 11/2001 Bamber ..... F41A 21/26 42/77
6,591,534 B1 * 7/2003 Trudeau ..... F41A 21/482 42/75.02
6,752,061 B2 * 6/2004 Knorich ..... F41A 21/481 42/75.02
6,990,764 B2 * 1/2006 Walker ..... F41A 21/40 42/76.01
7,681,483 B1 3/2010 Rhoades et al.
8,806,793 B2 * 8/2014 Daniel ..... F41C 23/16 42/72
9,267,754 B2 * 2/2016 Liljeholm ..... F41A 21/10
10,520,278 B2 * 12/2019 Myers ..... F41C 9/06
2011/0005376 A1 * 1/2011 Schmees ..... F41A 21/482 89/14.05
2013/0145669 A1 6/2013 Zonshine
2013/0280677 A1 10/2013 Liljeholm
2014/0345180 A1 * 11/2014 Koster ..... F41A 21/10 42/77
2016/0054096 A1 * 2/2016 Dzwill ..... F41A 21/48 42/75.02
2016/0097609 A1 * 4/2016 Penchuk ..... F41A 21/325 42/76.01
2017/0191779 A1 * 7/2017 Myers ..... F41A 21/30
2017/0284760 A1 * 10/2017 Maffett ..... F41A 21/484
2018/0128568 A1 * 5/2018 Iwasawa ..... F41A 21/487
2019/0086175 A1 * 3/2019 Karagias ..... F41A 21/482
2019/0170476 A1 * 6/2019 Hiler, Jr. ..... F41A 21/482
2020/0124373 A1 * 4/2020 Juarez ..... F41A 21/485

OTHER PUBLICATIONS

European Patent Office, Extended European Search Report for Application No. 18794786.6, dated Dec. 21, 2020, 7 pages, Germany.

* cited by examiner

ARRANGEMENT AND METHOD FOR ALIGNING A SUB-CALIBRE BARREL

CROSS REFERENCE TO RELATED APPLICATIONS

This application is a National Stage Application, filed under 35 U.S.C. 371, of International Application No. PCT/SE2018/050437, filed Apr. 27, 2018, which claims priority to Swedish Application No. 1700080-3, filed May 2, 2017; the contents of both of which are hereby incorporated by reference in their entirety.

BACKGROUND

Related Field

The present invention relates to a method and an arrangement for aligning a sub-calibre barrel inserted in a principal weapon.

Description of Related Art

Training weapons with a sub-calibre barrel arranged in the barrel of a principal weapon are well-known in the art. Training weapons are used to perform training exercises with training ammunition. Typically, an insert comprising a holder or adapter for a sub-calibre barrel is inserted in the barrel of a principal weapon, e.g. for firing of shells. As in any weapon, the sub-calibre barrel needs to be accurately aligned and held in place over time such that the sight corresponds to the angle of the sub-calibre weapon in the same way as the principal weapon.

In the art, it is known through e.g. EP 163028 that sub-calibre barrels can be aligned by insertion in a holder device in a principal weapon. The sub-calibre barrel is aligned by fixing screws at the front and rear parts of the barrel. However, over time, aligning of the barrel may need adjustment which conventionally has been performed by adjusting the fixing screws in the front part of the barrel thus bending the barrel while the rear part of the barrel remains fixed.

However, adjustment of fixing screws while maintaining the rear part of the sub-calibre barrel fixed is not always a reliable long-term solution to maintain durable aligning of the sub-calibre barrel. There is thus a need to extend the period of time of accurate aligning to avoid frequent adjustment of the sub-calibre barrel.

The present invention intends to provide a new arrangement and method of adjusting the sub-calibre barrel coping with the above-mentioned problems. Moreover, the present invention provides a more convenient way of adjusting the sub-calibre barrel without bending the barrel which also prolongs the life span. The invention also intends to reduce tensions in the sub-calibre barrel. In addition, the present invention results in less need of maintenance of the sub-calibre barrel.

BRIEF SUMMARY

The present invention relates to an arrangement for aligning a sub-calibre barrel for use in a principal weapon barrel comprising i) an insert arranged in said principal weapon barrel ii) front securing means for aligning the sub-calibre barrel iii) rear securing means for securing the rear end of the sub-calibre barrel, wherein iii.a) said rear securing means comprise a barrel nut in which said sub-calibre barrel is inserted;

iii.b) clamping means securing said barrel nut to said insert and said clamping means in said principal weapon barrel.

It has been found the present invention extends the period of time of accurate aligning compared to the prior art that adjusts the aligning of the sub-calibre barrel by bending the front of the barrel by means of securing means such as fixing screws. Bending of the front of the barrel is not needed according to the present invention. As the front of the barrel is bent as disclosed in the prior art, a need to align the barrel occurs more frequently. It has thus been found a more convenient way of adjusting (and aligning) the sub-calibre barrel according to the present invention. Preferably, while the rear end of the sub-calibre barrel is resting, e.g. in a loosely held turnable barrel nut, e.g. a barrel nut that is not yet secured by clamping means (enabling the inserted sub-calibre barrel to turn), the unsecured front end of the sub-calibre barrel can be aligned by leaning it in the desired direction without having to bend it by the front securing means. Preferably, the front end of the sub-calibre barrel is thus aligned and subsequently secured by means of front securing means such as fixing screws and thereafter the rear end of the sub-calibre barrel is secured, e.g. by means of fixing means such as fixing screws whereby the barrel nut is secured to the rear and front clamping means and the insert. Thus, by avoiding exposure of the barrel to tensions by bending the front end thereof, the barrel of the present invention is not worn to the same extent as in the prior art. The present invention thus offers a convenient way of securing the front and the rear ends of the sub-calibre barrel. The barrel nut, clamping means, and the insert thus in conjunction ascertain the rear end of the sub-calibre barrel is secured and that the sub-calibre barrel is aligned in conjunction with the securing means at the front of the barrel.

By the term "clamping means" is comprised e.g. clamping washer. According to one embodiment, the clamping means comprise front and a rear clamping means. Suitably, front and rear clamping means may be used such as a front clamping washer and a rear clamping washer. According to one embodiment, the front and rear clamping means secure the barrel nut at either side thereof. According to one embodiment, the sub-calibre barrel is threadedly affixed in the barrel nut. The barrel nut has a length L in the axial direction of the sub-calibre barrel. According to one embodiment, the sub-calibre barrel is inserted 40 to 60% of the length L of the barrel nut. According to one embodiment, the barrel nut has a rounded, elliptical or spheroidal exterior surface contacting the front and rear clamping means. According to one embodiment, the surface of the clamping means in contact with the surface of the barrel nut (2) is rounded, elliptical or spheroidal (as further illustrated in FIGS. 8*c* and 8*d*). By having rounded, elliptical or spheroidal contact surfaces of the clamping means and barrel nut, a smooth and even contact is provided safeguarding sufficient securing of the barrel nut independently of the aligning of the sub-calibre barrel. According to one embodiment, the surface of the clamping means in contact with the surface of the sub-calibre barrel nut is not rounded. According to one embodiment, the inner diameter of the clamping means is constant across its entire cross section (as further illustrated in FIG. 8*a*). According to one embodiment, the inner diameter of the clamping means is tapered across its cross section, at least at the portion of the inner diameter that is in contact with the barrel nut (as further illustrated in FIG. 8*b*). The shape of the inner diameter of the clamping means may thus vary. As long as the clamping means has a surface enabling safe securing of the barrel nut, aligning of the sub-calibre barrel may be provided. According to one embodiment, the barrel nut has an exterior rounded, elliptical or spheroidal shape to provide a contact surface corresponding to the shape of the clamping means. Preferably, the barrel nut has an exterior spheroidal shape such that its contact surface is the same independently of the aligning of the sub-calibre barrel. The barrel nut may, however, have other shapes as long as it can be secured by the clamping means. The term "screw" will when used without any further specification indicate a screw enabling fixing, i.e. a fixing screw.

According to one embodiment, at least three fixing means, such as fixing screws, are tightening said front and rear clamping means and said barrel nut to each other. According to one embodiment, the front clamping means is tightened to the insert, barrel nut and rear clamping means by means of fixing screws drawn from said front clamping means. According to one embodiment, the rear clamping means is tightened to the barrel nut, and the front clamping means by means of fixing screws drawn from the rear clamping means. According to one embodiment, six fixing screws are used to tighten the front and rear clamping means and the barrel nut to each other and to the insert. According to one embodiment, said rear and front clamping means are clamping washers.

The invention also relates to a training weapon comprising the arrangement as described herein. Preferably, the training weapon comprises an insert inside which is installed the sub-calibre barrel for subcalibre ammunition, a removable breech containing at least one holder for the sub-calibre ammunition, a firing pin, a hammer and a safety device.

According to one embodiment, the sub-calibre barrel is designed for ammunition calibres ranging from 1 to 20 mm, preferably from 2 to 13 mm.

The invention also relates to a method of aligning a training weapon comprising the arrangement as described herein. The method of aligning a training weapon comprises i) aligning the front end of the sub-calibre barrel by adjusting front securing means;

ii) securing the rear end of the sub-calibre barrel by rear securing means comprising front and rear clamping means and a barrel nut ii.a) securing front clamping means to the insert and the rear clamping means by fixing means, e.g. by drawing fixing screws 1) from said front clamping means via through holes of the insert into the rear clamping means; or 2) from said rear clamping means via through holes of the insert into the front clamping means; and optionally ii.b) securing the rear clamping means and the front clamping means by fixing means, e.g. by 1) drawing fixing screws from said rear clamping means into the front clamping means, or 2) drawing fixing screws from said front clamping means into the rear clamping means.

According to one embodiment, three fixing screws are drawn from front clamping means and three fixing screws are drawn from the rear clamping means.

Preferably, the front securing means are initially arranged such that the front end of the sub-calibre barrel can be easily adjusted. Preferably, and in order to safeguard the sub-calibre barrel is not bent, the rear end of the sub-calibre barrel is loosely held by the rear securing means, e.g. by allowing the barrel nut in which the sub-calibre barrel is fixedly inserted to turn as the front end of the sub-calibre barrel is leaned as desired to align it. In such embodiment, the sub-calibre barrel can be easily adjusted since the rear end of the sub-calibre barrel is not fixed but turnable with the barrel nut.

Preferably, the front of the sub-calibre barrel is aligned by means of adjustable front securing means, e.g. adjustable fixing means such as adjustable fixing screws. By means of the fixing means at the front of the sub-calibre barrel, the sub-calibre barrel can be secured with different angle or different aligning relative to the principal barrel.

Preferably, the front securing means securing the front end of the sub-calibre barrel protrude through bores in the barrel of the principal weapon thus safeguarding the sub-calibre barrel is accurately aligned along the principal barrel. Additional securing means preferably attach the insert to the principal barrel in a conventional manner.

Preferably, the rear securing means secure the sub-calibre barrel by means of at least three fixing means, preferably by means of at least six fixing means.

Preferably, the sub-calibre barrel is inserted halfway into the barrel nut.

Preferably, the clamping means comprises a front and a rear washer provided with holes for securing the barrel nut and the front and rear washers to one another by means of fixing screws. Preferably, in embodiments in which the fixing screws are drawn from the front clamping means, the rear clamping means is provided with threaded holes. Preferably, the insert is provided with through holes through which fixing screws drawn from the front clamping means pass and continue into the rear clamping means provided with corresponding threaded holes. Preferably, as an alternative, fixing screws may also be drawn from the rear clamping means whereby the front clamping means need to be provided with threaded holes instead of the rear clamping means. Preferably, in embodiments in which fixing screws are drawn from the rear washer, the front washer is provided with threaded holes.

Preferably, a gear ring is arranged on the sub-calibre barrel in front of the barrel nut in the firing direction. The gear ring is preferably threadedly adjustable along the sub-calibre barrel to enable re-adjustment of the insertion of the sub-calibre barrel into the barrel nut, i.e. to what extent the sub-calibre barrel is inserted into the barrel nut having a length L. The gear ring thus secures suitable insertion of the sub-calibre barrel into the barrel nut. Preferably, the gear ring is arranged such that the sub-calibre barrel can be inserted about half-way into the barrel nut, i.e. a length L/2.

Preferably, a bolt is inserted halfway into the barrel nut from the opposite side of the barrel nut, i.e. from the rear part of the barrel nut seen in the firing direction. In such embodiment, the front end of the bolt is preferably secured in the barrel nut by means of a bayonet mount adjacent to the rear end of the sub-calibre barrel. According to this embodiment, a bolt is inserted about halfway into the barrel nut from the rear end thereof (seen from the fire direction) and the sub-calibre barrel is inserted halfway into the barrel nut from the front end thereof (seen from the fire direction).

According to one embodiment, the space between the bolt and the radial surrounding of the insert is adapted to allow angling of the bolt. If the sub-calibre barrel is inclined downwards for example 1° relative to the principal barrel assuming the sub-calibre barrel and the principal barrel were parallel from the outset, the barrel nut will be turned accordingly and the bolt will be angled such that the space between the bolt and the surrounding insert becomes smaller. The rear end of the bolt will then no longer be coaxially oriented with the barrel of the principal weapon. Instead, the rear end of the bolt will be turned toward the upper surface of the principal barrel if the sub-calibre barrel is inclined downwards 1°. A skilled person knows what appropriate dimensioning of the insert and securing means are needed to allow for accurate aligning. Preferably, the arrangement according to the invention is applicable to training with e.g. recoilless weapons but may be implemented in any suitable weapon type.

DETAILED DESCRIPTION OF THE INVENTION

Figure 1:
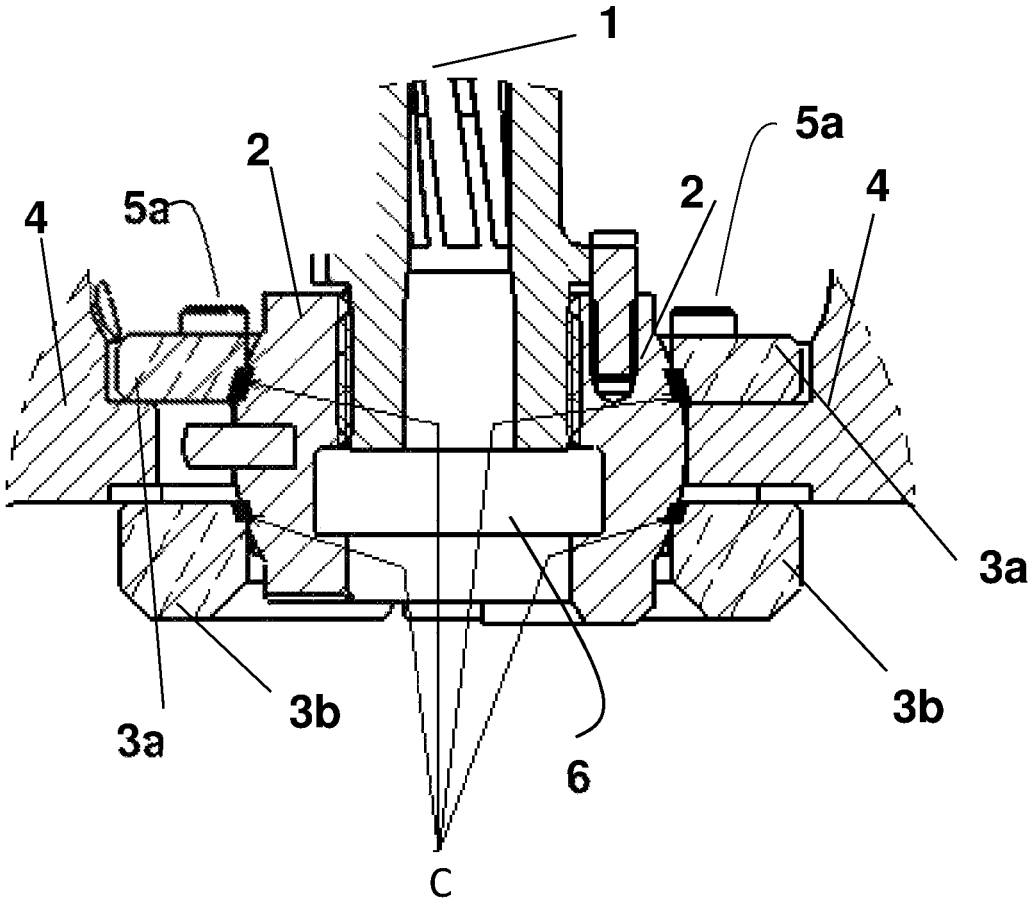
FIG. 1 shows a cross section of a barrel nut secured by clamping washers.

FIG. 1 shows a sub-calibre barrel 1, the rear end of which being inserted and secured in a barrel nut 2. Barrel nut 2 is secured by clamping washers 3*a* and 3*b*. Clamping washer 3*a* is secured to insert (adapter) 4 and clamping washer 3*b* by means of tightening screws 5*a*. Surfaces C are exposed to pressure by clamping washers 3*a* and 3*b* to maintain the barrel nut 2 in place. Screws 5*a* assist in tightening the clamping washers 3*a*, 3*b* together thereby securing the barrel nut 2 and, as a consequence, sub-calibre barrel 1. A bolt 6 inserted in the rear end of barrel nut 2 is attached by means of a bayonet mount.

Preferably, clamping washers 3*a*, 3*b* are secured to barrel nut 2 by the following procedure:

Three fixing screws 5*a* for securing front clamping washer 3*a* are tightening front clamping washer 3*a* to insert (adapter) 4. Front clamping washer 3*a* and insert 4 are provided with through holes through which said three fixing screws 5*a* tighten insert 4 to front clamping washer 3*a*. Clamping washer 3*b* is likewise provided with corresponding holes which are threaded. Fixing screws 5*a* thus also tighten front and rear clamping washers 3*a* (which may be provided with threads) and 3*b* (which are provided with threads) and barrel nut 2. The fixing screws 5*a* are drawn from clamping washer 3*a* in FIG. 1. However, fixing screws may also be drawn from clamping washer 3*b* in which case clamping washer 3*a* must be provided with threads to allow for tightening.

Sub-calibre barrel 1 is inserted and secured in barrel nut 2. Rear clamping washer 3*b*, barrel nut 2, and front clamping washer 3*a* are provided with holes through which fixing screws 5*b* (not visible in FIG. 1) can be drawn from the rear clamping washer 3*b* to tighten it to the clamping washer 3*a* provided with threads whereby barrel nut 2 is held in place relative to the washers (3*a*, 3*b*) and the insert 4.

Figure 2:
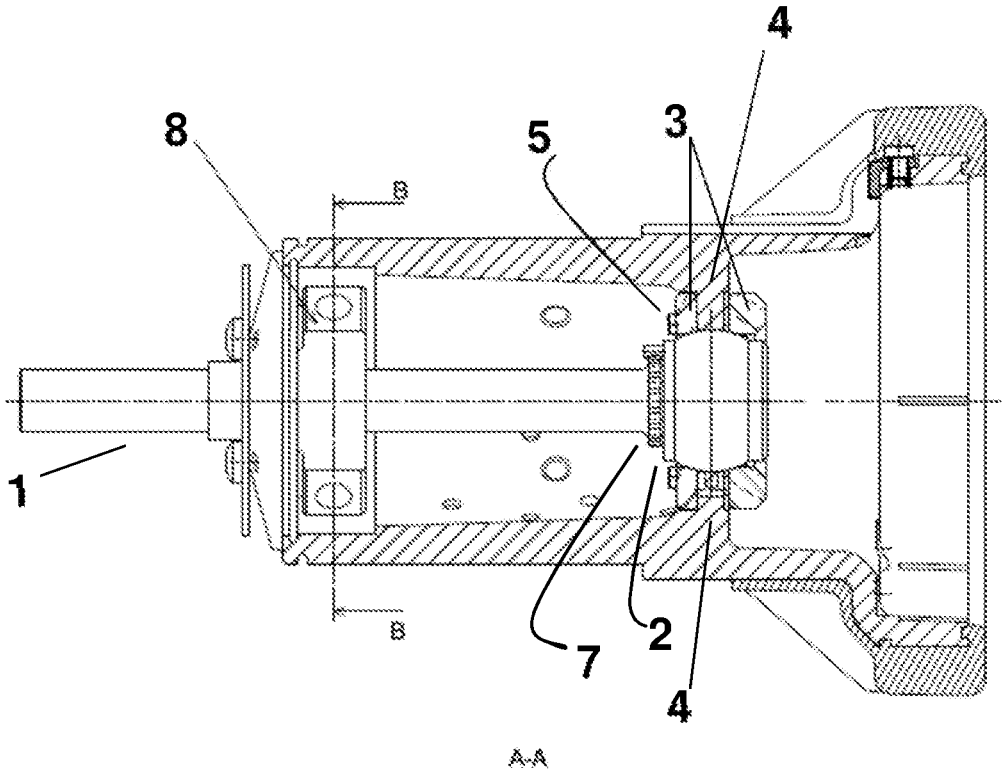
FIG. 2 shows a cross section of a sub-calibre barrel insert.

FIG. 2 shows a barrel nut 2 and a gear ring 7 impeding further insertion of sub-calibre barrel 1 into barrel nut 2. The ring 7 may be adjusted to modify the degree of insertion into barrel nut 2 depending on the ammunition used. Clamping washers 3 are tightened to barrel nut 2 and insert 4 by means of screws 5 thereby affixing barrel nut 2 and as a consequence sub-calibre barrel 1. Alignment screws 8 can be adjusted to align the front end of the sub-calibre barrel 1. The alignment screws affixing the front end of the barrel secures the aligning is maintained in the front end of the barrel.

Figure 3:
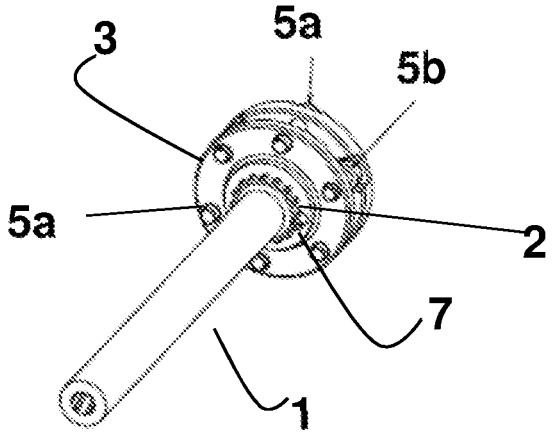
FIG. 3 shows a perspective view of a sub-calibre barrel, barrel nut, and clamping washers.

FIG. 3 shows a perspective view of a barrel 1 inserted in barrel nut 2 which is secured by clamping washers 3 by means of screws 5*a*, 5*b*. The gear ring 7 on sub-calibre barrel 1 determines the extent of insertion of the sub-calibre barrel 1 into the barrel nut 2.

Figure 4:
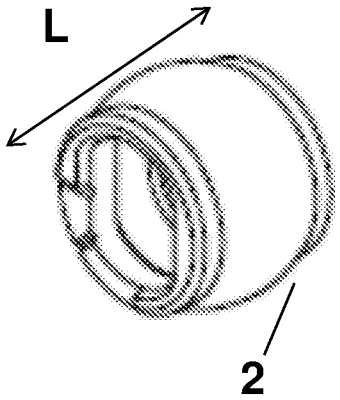
FIG. 4 shows a perspective view of the exterior surface of a spheroidal barrel nut.

FIG. 4 shows a perspective view of a spheroidal barrel nut 2 with a length L. Preferably, the spheroidal barrel nut has an exterior spheroidal shape to provide the same contact surface to the clamping washers irrespective of the aligning of the sub-calibre barrel 1. For example, if the aligning of the barrel is adjusted 2° downwards, the barrel nut affixing the barrel will be turned downwards to the same extent as the barrel. Still, however, the contacting surface against the clamping washers will be the same. Therefore, clamping washers having a corresponding contacting surface against the barrel nut will always correspond and fit smoothly to the exterior surface of the barrel nut and safeguard good contacting.

Figure 5:
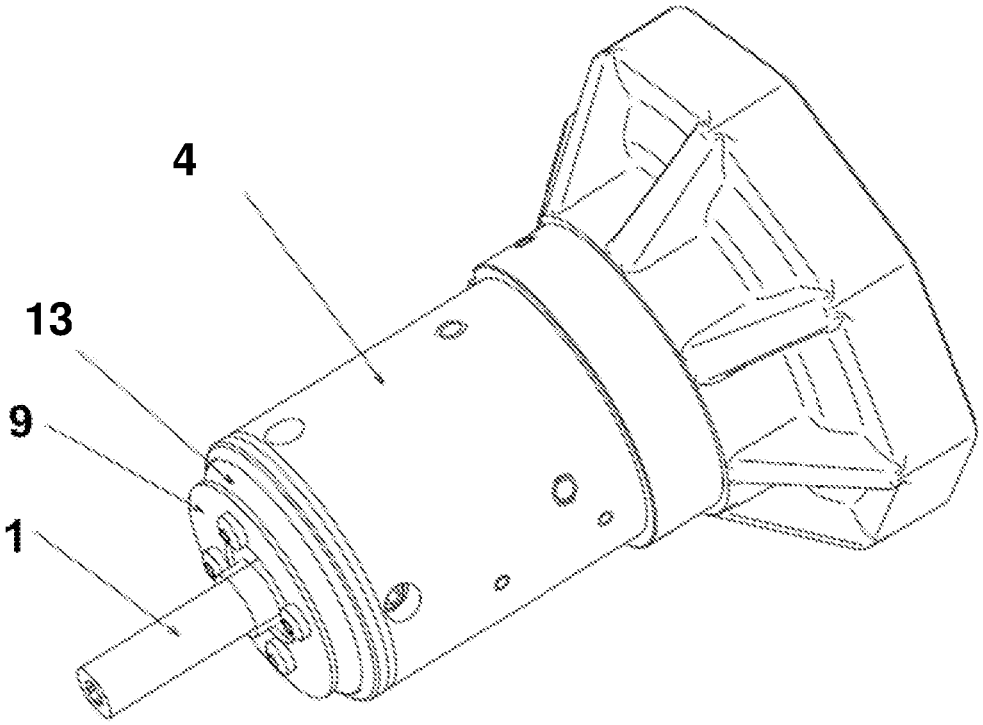
FIG. 5 shows an insert arrangement comprising a sub-calibre barrel.

FIG. 5 shows an insert 4 in which sealing ring 9, and membrane 13 are arranged. Sealing ring 9 holds membrane 13 in place to prevent powder gases from entering.

Figure 6:
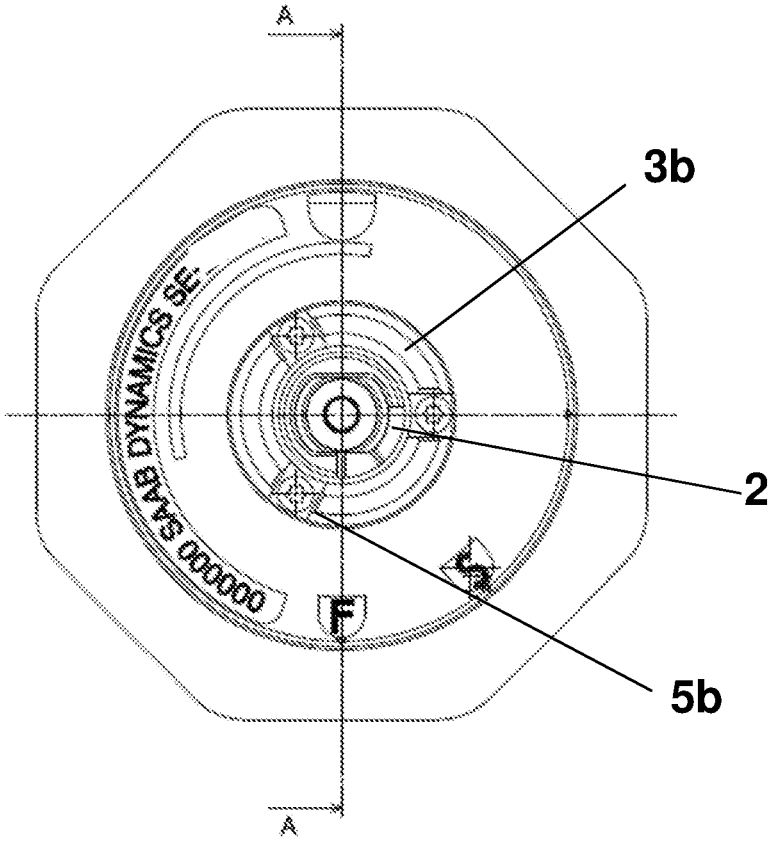
FIG. 6 shows the rear end of a barrel nut where the bolt is inserted and the rear clamping washer.

FIG. 6 shows a barrel nut 2 from the rear end thereof. Clamping washer 3*b* is tightened against barrel nut 2 and clamping washer 3*a* (not shown) provided with threaded holes adapted for screws 5*b* drawn from clamping washer 3*b*.

Figure 7:
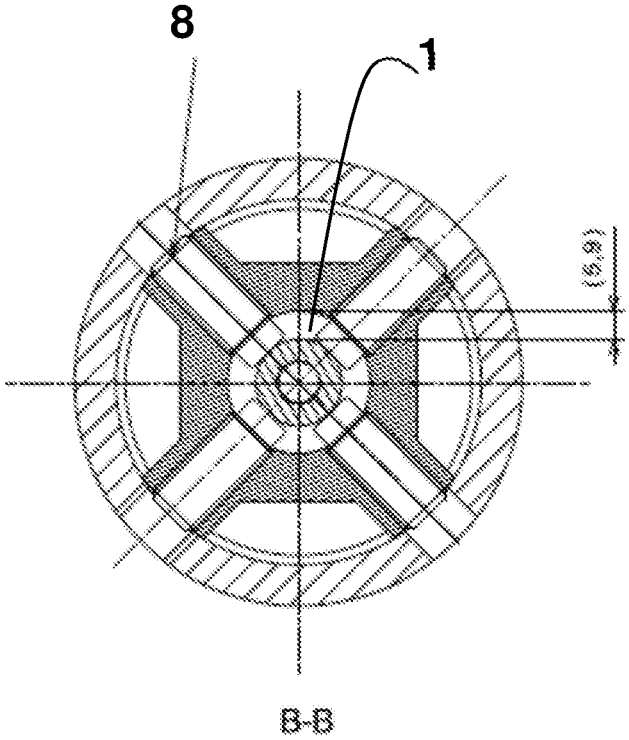
FIG. 7 shows a cross section of a front arrangement for securing the front of the sub-calibre barrel by means of screws.

FIG. 7 shows fixing screws 8 adjusting and aligning sub-calibre barrel 1.

Figure 8A:
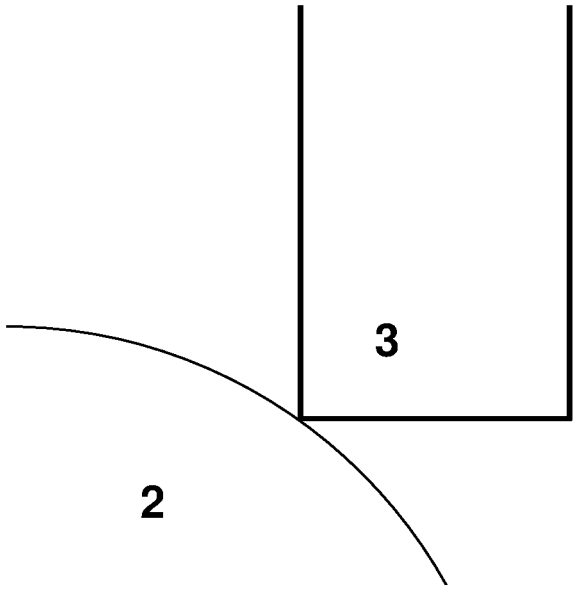
FIGS. 8*a-d* show cross sections of clamping means with different shapes contacting the barrel nut.
Figure 8B:
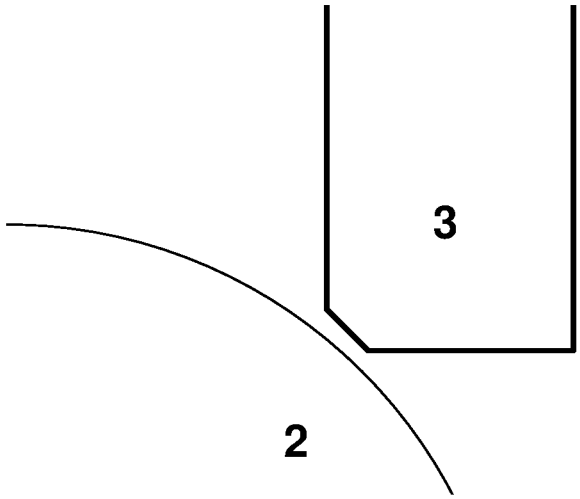
Figure 8C:
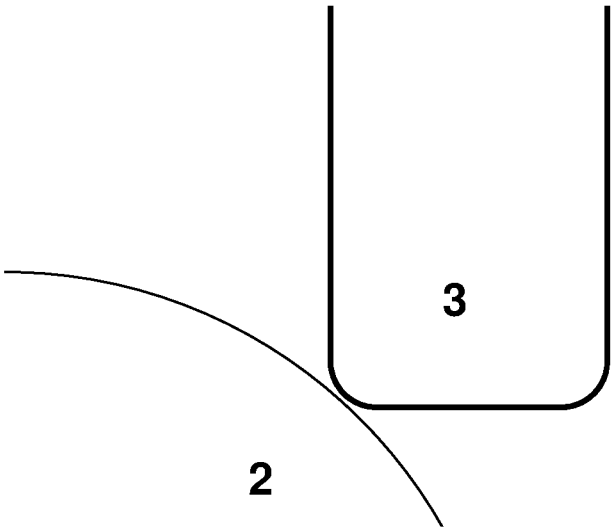
Figure 8D:
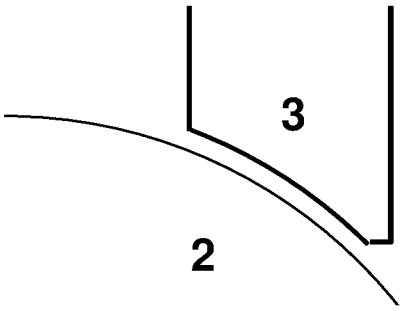

FIGS. 8*a-d* show different cross sections of clamping means 3, typically a clamping washer, having differently shaped surfaces contacting the barrel nut 2 (compare areas C of FIG. 1). The dotted line of FIGS. 8*a-d* illustrates the symmetry line (central line) of the clamping means 3. In FIG. 8*a*, only an edge of the clamping means is in contact with the barrel nut. Still, such contact may be sufficient to maintain the barrel nut fixed such that the sub-calibre barrel remains aligned in a stable way. In FIG. 8*b*, the portion of the clamping means has been tapered. This portion corresponds to the surface of the clamping means 3 that is in contact with the barrel nut 2 (compare areas C of FIG. 1). This embodiment enables a smoother contact with the barrel nut than in FIG. 8*a* which still may be sufficient. FIG. 8*c* shows a rounded edge of the clamping means 3 in contact with the barrel nut 2 (compare areas C of FIG. 1). This also renders the contact between the clamping means 3 and the barrel nut 2 smoother than in FIG. 8*a*. In FIG. 8*d*, the whole inner surface of the clamping means 2 has been shaped to smoothly fit the barrel nut 2. While the embodiment of FIG. 8*d* may be preferred, the embodiment of e.g. FIG. 8*a* may be sufficient if the aligning of the training weapon need not be maintained for a very long period of time. An advantage of the shape of the clamping means 3 of FIG. 8*a* may be for example more cost-effective production thereof. Different embodiments may thus be selected depending on the application.

The invention claimed is:

1. Arrangement for aligning a sub-calibre barrel having a longitudinal axis, the arrangement comprising:

an insert;

one or more alignment screws for aligning the sub-calibre barrel;

a barrel nut into which a rear end of the sub-calibre barrel is inserted for securing the rear end; and a front clamping washer and a rear clamping washer positioned on either side of the barrel nut along the longitudinal axis of the sub-calibre barrel, wherein said front clamping washer and said rear clamping washer secure said barrel nut to said insert via one or more fixing screws.

2. Arrangement according to claim 1, wherein the sub-calibre barrel is threadedly affixed in the barrel nut.

3. Arrangement according to claim 1, wherein the sub-calibre barrel is inserted 40 to 60% of the length of the barrel nut.

4. Arrangement according to claim 1, wherein the barrel nut has a rounded, elliptical or spheroidal exterior surface contacting the front and rear clamping washers.

5. Arrangement according to claim 1, wherein a surface of said front and rear clamping washers in contact with the surface of the barrel nut is rounded, elliptical or spheroidal.

6. Arrangement according to claim 1, wherein the one or more fixing screws comprise at least three fixing screws configured for tightening said front and rear clamping washers and said barrel nut to each other.

7. Arrangement according to claim 1, wherein the front clamping washer is tightened to the insert, barrel nut, and the rear clamping washer via one set of screws of said fixing screws drawn from said front clamping washer.

8. Arrangement according to claim 1, wherein the rear clamping washer is tightened to barrel nut and the front clamping washer via one set of screws of said fixing screws drawn from the rear clamping washer.

9. Arrangement according to claim 1, wherein the one or more fixing screws comprise six screws collectively configured to tighten the front and rear clamping washers, said barrel nut and said insert to each other.

10. Arrangement according to claim 1, wherein a bolt is inserted in a rear part of barrel nut.

11. Training weapon comprising the arrangement according to claim 1.

12. Method of aligning a training weapon according to claim 11, the method comprising the steps of:

aligning the front end of the sub-calibre barrel by adjusting the one or more alignment screws;

securing the rear end of the sub-calibre barrel by positioning said front and rear clamping washers at either side of said barrel nut along the longitudinal axis of the sub-calibre barrel; and securing said front clamping washer to said insert and said rear clamping washer via one or more fixing screws.

13. Method according to claim 12, wherein one set of screws of the one or more fixing screws are drawn from front clamping washer and another set of screws of the one or more fixing screws are drawn from the rear clamping washer.

* * * * *